US009446282B2

(12) United States Patent
Thorpe

(10) Patent No.: US 9,446,282 B2
(45) Date of Patent: Sep. 20, 2016

(54) EXERCISE DEVICE

(71) Applicant: Ricky V. Thorpe, Davie, FL (US)

(72) Inventor: Ricky V. Thorpe, Davie, FL (US)

( * ) Notice: Subject to any disclaimer, the term of this patent is extended or adjusted under 35 U.S.C. 154(b) by 45 days.

(21) Appl. No.: 14/467,306

(22) Filed: Aug. 25, 2014

(65) Prior Publication Data

US 2016/0051852 A1 Feb. 25, 2016

(51) Int. Cl.

| | |
|---|---|
| ***A63B 21/068*** | (2006.01) |
| ***A63B 26/00*** | (2006.01) |
| ***A63B 21/00*** | (2006.01) |
| ***A63B 23/12*** | (2006.01) |

(52) U.S. Cl.

CPC ..... *A63B 21/068* (2013.01); *A63B 21/00047* (2013.01); *A63B 23/1218* (2013.01); *A63B 23/1227* (2013.01)

(58) Field of Classification Search

CPC ..... A63B 22/16; A63B 21/4037; A63B 21/4039; A63B 21/00047; A63B 21/00185; A63B 21/068; A63B 21/4035; A63B 23/1218; A63B 23/1227

See application file for complete search history.

(56) References Cited

U.S. PATENT DOCUMENTS

| | | | | |
|---|---|---|---|---|
| 4,620,701 | A * | 11/1986 | Mojden | A63B 3/00 482/142 |
| 7,104,939 | B1 * | 9/2006 | Martinez | A63B 21/068 482/142 |
| 7,455,634 | B2 * | 11/2008 | Barniak | A63B 3/00 482/143 |
| 7,534,200 | B1 * | 5/2009 | Martinez | A63B 21/00047 482/142 |
| 7,857,739 | B2 * | 12/2010 | Caldwell | A63B 21/00047 482/130 |
| 9,138,609 | B2 * | 9/2015 | Placide | A63B 21/068 |
| 2013/0102443 | A1 * | 4/2013 | Lundquist | A63B 21/068 482/93 |
| 2015/0126348 | A1 * | 5/2015 | Kaye | A63B 21/0442 482/130 |

* cited by examiner

*Primary Examiner* — Oren Ginsberg
(74) *Attorney, Agent, or Firm* — Johnson & Martin, P.A.; James David Johnson

(57) ABSTRACT

An exercise device is provided including a vertical support tube, base section, middle section, back support section, and upper section. The base section may include a base brace attachable to the vertical support tube, a base mounting plate attachable to the base brace, and legs. The middle section may removably attach to the vertical support tube and provide front bars and arm supports. The back support section may provide an adjustable back support pad. The upper section may provide one or more upper handles. The legs, the front bars, and the arm supports are rotatable to at least a down position and an up position.

13 Claims, 6 Drawing Sheets

EXERCISE DEVICE

FIELD OF THE INVENTION

The invention relates to an exercise device. More particularly, the invention relates to a transformable device used to exercise.

BACKGROUND

Throughout history, physical activity has been a crucial aspect of everyday life. As humans are physically active, their muscles are strengthened and endurance increased. However, modern society has reduced the amount of physical activity needed to survive. Therefore, many humans exercise to maintain physical fitness. Often, this exercise includes various routines performable on dedicated devices.

Typically, exercise machines are designed to perform a limited number of exercise routines. A person desiring to perform many exercise routines may require membership to a gym just to have access to the multitude of necessary exercise machines necessary to work various muscle groups. Gym memberships can be costly, but purchasing and maintaining all the machines that would be required by a gym is even more costly.

Some users attempt to forgo gym membership by purchasing home exercise equipment. However, many home exercise machines fail to provide a wide range of motion, flexibility of exercise routines performable on the machine, and customizability of the machine to a user. Home exercise machines also typically fail to isolate and stabilize muscles being worked during an exercise routine. Many home exercise machines lack an ability to train in multiple planes of motion, instead encouraging repeated exercises that target isolated muscle groups.

What is needed is an exercise device that substantially eliminates the need of numerous discrete exercise machines. What is needed is an exercise device that is adjustable to accommodate a user. What is needed is an exercise device that is at least partially collapsible to facilitate storage of the device.

SUMMARY

The present invention provides an exercise device with a novel configuration to minimize use of excess tubing and allow for increased functionality. Various components of the device may include a sleeve or collar, which may be slidably positioned about a vertical support tube. The device may also be compactable, facilitating storage and transportation efforts.

The present invention provides an exercise device that substantially eliminates the need of numerous discrete exercise machines. The present invention provides an exercise device that is adjustable to accommodate a user. The present invention provides an exercise device that is at least partially collapsible to facilitate storage of the device.

According to an embodiment of the present invention, an exercise device is provided including a vertical support tube, a base section, a middle section, and an upper section. The base section may be operatively attached at a bottom end of the vertical support tube. The base section may further include a base brace attachable to the vertical support tube, a base mounting plate attachable to the base brace, and a leg operatively attached to the base mounting plate. The leg may be at least partially rotatable about a leg mounting bolt connected to the base mounting plate. The middle section may be removably attachable to the vertical support tube, the middle section being movable about the vertical support tube. The middle section may further include a middle brace adjustably positionable about the vertical support tube, a middle mounting plate attached to the middle brace, a front bar operatively attached to the middle mounting plate, and an arm support operatively attached to the middle mounting plate. The front bar may be at least partially rotatable about a front bar mounting bolt connected to the middle mounting plate. The arm support may be at least partially rotatable about an arm support mounting bolt connected to the middle mounting plate. The upper section may be attachable to a top end of the vertical support tube. The upper section may further include an upper handle. The leg, the front bar, and the arm support are rotatable to at least a down position and an up position.

In another aspect, the device may include a back support section attachable to the vertical support tube. The back support section may include a back support pad. The back support section may be movable about the vertical support tube between the base section and the upper section.

In another aspect, the back support section may include a back support portion securable to the vertical mounting tube, a back support mounting bracket attached to the back support portion, and a back support pad mounting bracket connectable to the back support mounting bracket via a back support pivot bolt. The back support pad mounting bracket may be pivotal about the back support pivot bolt to orient the attached back support pad.

In another aspect, the base portion may include a base mounting bracket, further including a leg mounting hole, a leg pin up receiver, and a leg pin down receiver. The leg may include a leg pin. The leg may be at least partially rotatable about the leg mounting bolt passed through the base mounting bracket, the base mounting plate, and the leg. The leg may be selectively positionable in the up position by engaging the leg pin up receiver with the leg pin. The leg may be selectively positionable in the down position by engaging the leg pin down receiver with the leg pin.

In another aspect, the middle portion may include a middle mounting bracket, further including a front bar mounting hole, a front bar pin up receiver, and a front bar pin down receiver. The front bar further may include a front bar pin. The front bar may be at least partially rotatable about the front bar mounting bolt passed through the middle mounting bracket, the middle mounting plate, and the front bar. The front bar may be selectively positionable in the up position by engaging the front bar pin up receiver with the front bar pin. The front bar may be selectively positionable in the down position by engaging the front bar pin down receiver with the front bar pin.

The middle portion may include a middle mounting bracket, further including an arm support mounting hole, an arm support pin up receiver, and an arm support pin down receiver. The arm support may include an arm support pin. The arm support may be at least partially rotatable about the arm support mounting bolt passed through the middle mounting bracket, the middle mounting plate, and the arm support. The arm support may be selectively positionable in the up position by engaging the arm support pin up receiver with the arm support pin. The arm support may be selectively positionable in the down position by engaging the arm support pin down receiver with the arm support pin.

In another aspect, the upper section may include an upper support tube extending from a first upper support tube end to a second upper support tube end. The upper support tube may include an upper support tube bend between the first upper support tube end and the second upper support tube end. The first upper support tube end may be approximately orthogonal to the second upper support tube end. The first upper support tube end of the upper support tube may be attachable to the vertical support tube.

In another aspect, the upper handle may be attachable to the second upper support tube end of the upper support tube. The upper handle may extend from an upper handle support end to an upper handle distal end. The upper handle may bend between the upper handle support end and the upper handle distal end. The upper handle support end may be approximately orthogonal to the upper handle distal end.

In another aspect, the upper handle may include a first side upper handle and a second side upper handle.

In another aspect, the vertical support tube may be an approximately square tube.

In another aspect, the upper handle further may include a grip.

In another aspect, the front bar may include bar orientation holes. The middle section may include a bar handle with a bar orientation pin receivable by the bar orientation hole. The bar handle may be insertable into the front bar. The bar handle may be rotatably oriented with respect to the front bar. The bar orientation pin may be aligned with the bar orientation hole corresponding to an orientation.

In another aspect, the arm support may include an arm pad mountable to the arm support and an arm support handle approximately orthogonally mounted to the arm support.

According to an embodiment of the present invention, an exercise device is provided that includes a vertical support tube, a base section, a middle section, a back support section, and an upper section. The base section may be operatively attached at a bottom end of the vertical support tube. The base section may further include a base brace attachable to the vertical support tube, a base mounting plate attachable to the base brace, and a leg operatively attached to the base mounting plate. The leg may be at least partially rotatable about a leg mounting bolt connected to the base mounting plate.

The middle section may be removably attachable to the vertical support tube. The middle section may be movable about the vertical support tube. The middle section may include a middle brace adjustably positionable about the vertical support tube, a middle mounting plate attached to the middle brace, a front bar, and an arm support.

The front bar may be operatively attached to the middle mounting plate. The front bar may be at least partially rotatable about a front bar mounting bolt connected to the middle mounting plate. The front bar may include bar orientation holes. A bar handle with a bar orientation pin may be receivable by the bar orientation hole. The bar handle may be rotatably oriented with respect to the front bar such that the bar orientation pin is aligned with the bar orientation hole corresponding to an orientation.

The arm support may be operatively attached to the middle mounting plate. The arm support may be at least partially rotatable about an arm support mounting bolt connected to the middle mounting plate. The arm support may include an arm pad mountable to the arm support and an arm support handle approximately orthogonally mounted to the arm support.

The upper section may be attachable to a top end of the vertical support tube. The upper section may include an upper handle.

The back support section may be attachable to the vertical support tube. The back support section may include a back support pad. The back support section may be movable about the vertical support tube between the base section and the upper section. The back support section may include a back support portion securable to the vertical mounting tube, a back support mounting bracket attached to the back support portion, and a back support pad mounting bracket connectable to the back support mounting bracket via a back support pivot bolt. The back support pad mounting bracket may be pivotal about the back support pivot bolt to orient the attached back support pad. The leg, the front bar, and the arm support may be rotatable to at least a down position and an up position.

In another aspect, the base portion may include a base mounting bracket, further including a leg mounting hole, a leg pin up receiver, and a leg pin down receiver. The leg may include a leg pin. The leg may be at least partially rotatable about the leg mounting bolt passed through the base mounting bracket, the base mounting plate, and the leg. The leg may be selectively positionable in the up position by engaging the leg pin up receiver with the leg pin. The leg may be selectively positionable in the down position by engaging the leg pin down receiver with the leg pin.

In another aspect, the middle portion may include a middle mounting bracket, further including a front bar mounting hole, a front bar pin up receiver, and a front bar pin down receiver. The front bar may include a front bar pin. The front bar may be at least partially rotatable about the front bar mounting bolt passed through the middle mounting bracket, the middle mounting plate, and the front bar. The front bar may be selectively positionable in the up position by engaging the front bar pin up receiver with the front bar pin. The front bar may be selectively positionable in the down position by engaging the front bar pin down receiver with the front bar pin.

The middle portion may include a middle mounting bracket, further including an arm support mounting hole, an arm support pin up receiver, and an arm support pin down receiver. The arm support may include an arm support pin. The arm support may be at least partially rotatable about the arm support mounting bolt passed through the middle mounting bracket, the middle mounting plate, and the arm support. The arm support may be selectively positionable in the up position by engaging the arm support pin up receiver with the arm support pin. The arm support may be selectively positionable in the down position by engaging the arm support pin down receiver with the arm support pin.

In another aspect, the upper section may include an upper support tube extending from a first upper support tube end to a second upper support tube end. The upper support tube may include an upper support tube bend between the first upper support tube end and the second upper support tube end. The first upper support tube end may be approximately orthogonal to the second upper support tube end. The first upper support tube end of the upper support tube may be attachable to the vertical support tube. The upper handle may be attachable to the second upper support tube end of the upper support tube. The upper handle may extend from an upper handle support end to an upper handle distal end. The upper handle may bend between the upper handle support end and the upper handle distal end. The upper handle support end may be approximately orthogonal to the upper handle distal end.

According to an embodiment of the present invention, an exercise device is provided including a vertical support tube, a base section, a middle section, and an upper section. The base section may be operatively attached at a bottom end of the vertical support tube. The base section may include a base brace attachable to the vertical support tube, a base mounting plate attachable to the base brace, and a leg operatively attached to the base mounting plate. The leg may be at least partially rotatable about a leg mounting bolt connected to the base mounting plate. The base section may additionally include a leg mounting hole, a leg pin up receiver, and a leg pin down receiver. The leg may include a leg pin. The leg mounting bolt may be passed through the base mounting bracket, the base mounting plate, and the leg. The leg may be selectively positionable in an up position by engaging the leg pin up receiver with the leg pin. The leg may be selectively positionable in a down position by engaging the leg pin down receiver with the leg pin.

The middle section may be removably attachable to the vertical support tube. The middle section may be movable about the vertical support tube. The middle section may include a middle brace adjustably positionable about the vertical support tube, a middle mounting plate attached to the middle brace, and a front bar operatively attached to the middle mounting plate.

The front bar may be at least partially rotatable about a front bar mounting bolt connected to the middle mounting plate. The middle section may additionally include a front bar mounting hole, a front bar pin up receiver, and a front bar pin down receiver. The front bar may include a front bar pin. The front bar mounting bolt may be passed through the middle mounting bracket, the middle mounting plate, and the front bar. The front bar may be selectively positionable in an up position by engaging the front bar pin up receiver with the front bar pin. The front bar may be selectively positionable in a down position by engaging the front bar pin down receiver with the front bar pin.

The arm support may be operatively attached to the middle mounting plate. The arm support may be at least partially rotatable about an arm support mounting bolt connected to the middle mounting plate. The middle section may additionally include an arm support mounting hole, an arm support pin up receiver, and an arm support pin down receiver. The arm support may include an arm support pin. The arm support mounting bolt may be passed through the middle mounting bracket, the middle mounting plate, and the arm support. The arm support may be selectively positionable in an up position by engaging the arm support pin up receiver with the arm support pin. The arm support may be selectively positionable in a down position by engaging the arm support pin down receiver with the arm support pin.

The upper section may be attached to a top end of the vertical support tube, the upper section including an upper handle. The leg, the front bar, and the arm support may be rotatable to at least a down position and an up position.

In another aspect, the upper section may include an upper support tube extending from a first upper support tube end to a second upper support tube end. The upper support tube may include an upper support tube bend between the first upper support tube end and the second upper support tube end. The first upper support tube end may be approximately orthogonal to the second upper support tube end. The first upper support tube end of the upper support tube may be attachable to the vertical support tube. The upper handle may be attachable to the second upper support tube end of the upper support tube. The upper handle may extend from an upper handle support end to an upper handle distal end. The upper handle may bend between the upper handle support end and the upper handle distal end. The upper handle support end may be approximately orthogonal to the upper handle distal end.

In another aspect, the middle section may include bar orientation holes provided by the front bar, a bar handle including a bar orientation pin receivable by the bar orientation hole, an arm pad mountable to the arm support, and an arm support handle approximately orthogonally mounted to the arm support. The bar handle may be insertable into the front bar. The bar handle may be rotatably oriented with respect to the front bar. The bar orientation pin may be aligned with the bar orientation hole corresponding to an orientation.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
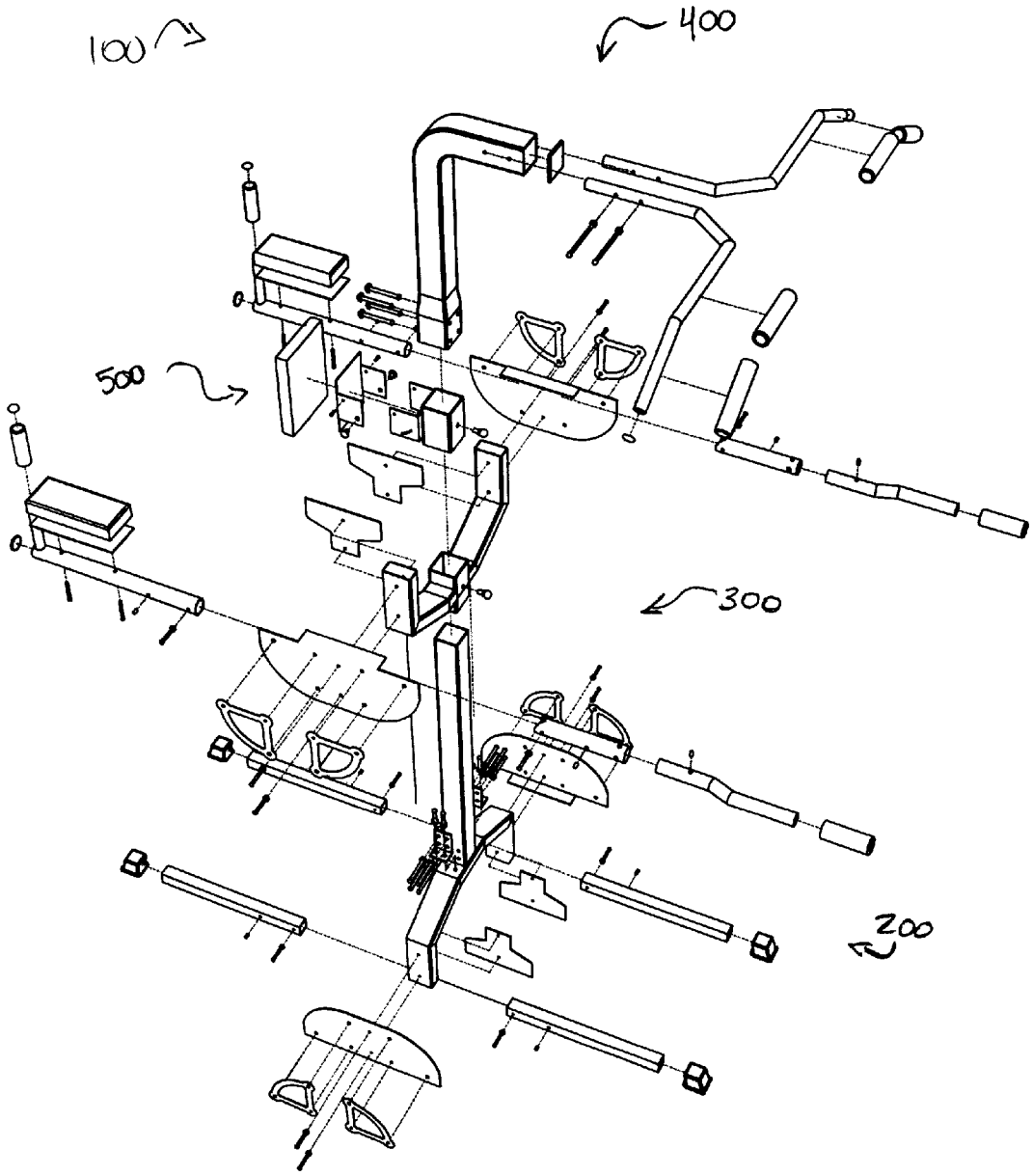
FIG. 1 is an exploded perspective view of an exercise device, according to an embodiment of the present invention.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. In addition, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Figure 2:
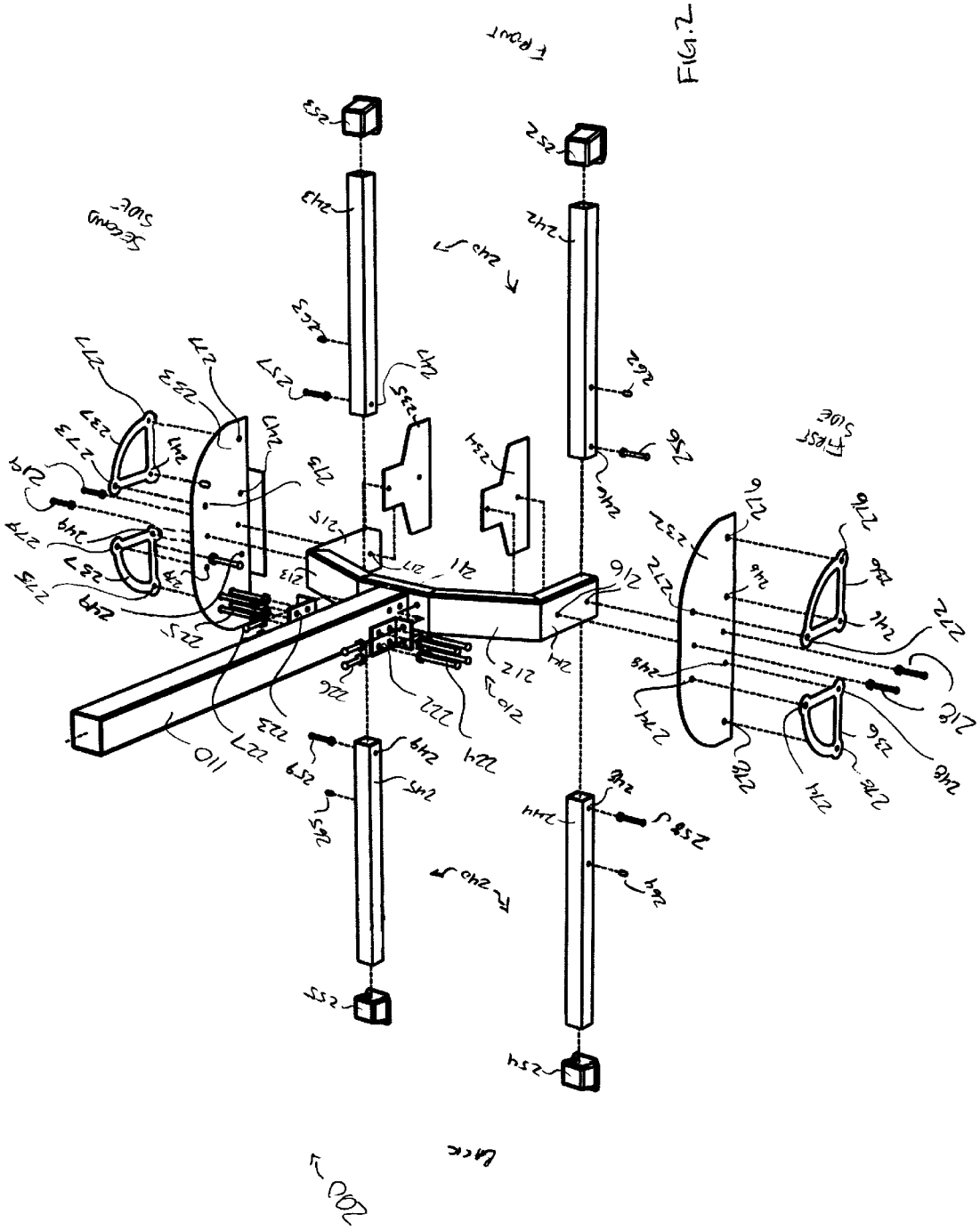
FIG. 2 is an exploded perspective view of the base section shown in FIG. 1.
Figure 3:
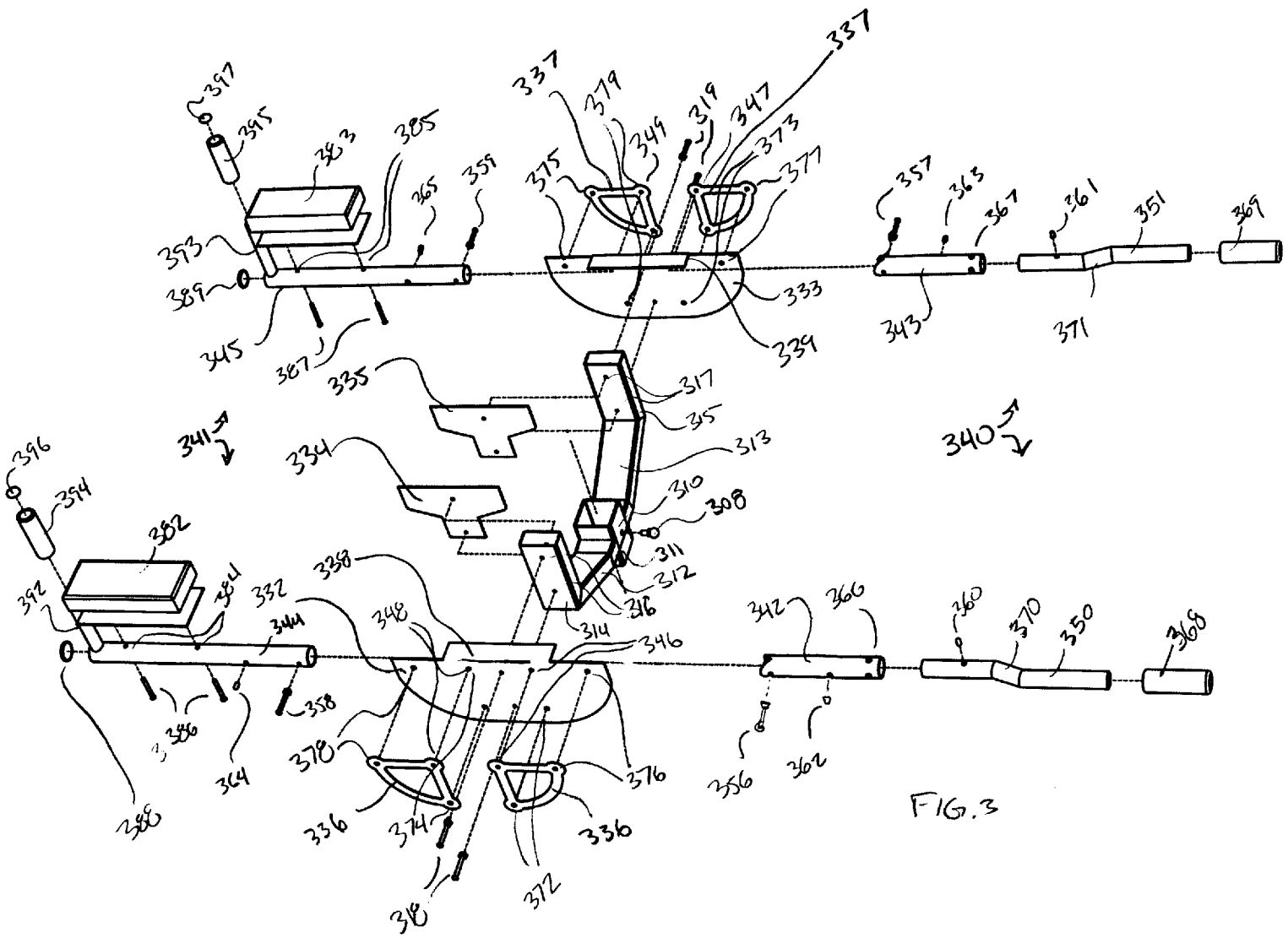
FIG. 3 is an exploded perspective view of the middle section shown in FIG. 1.
Figure 4:
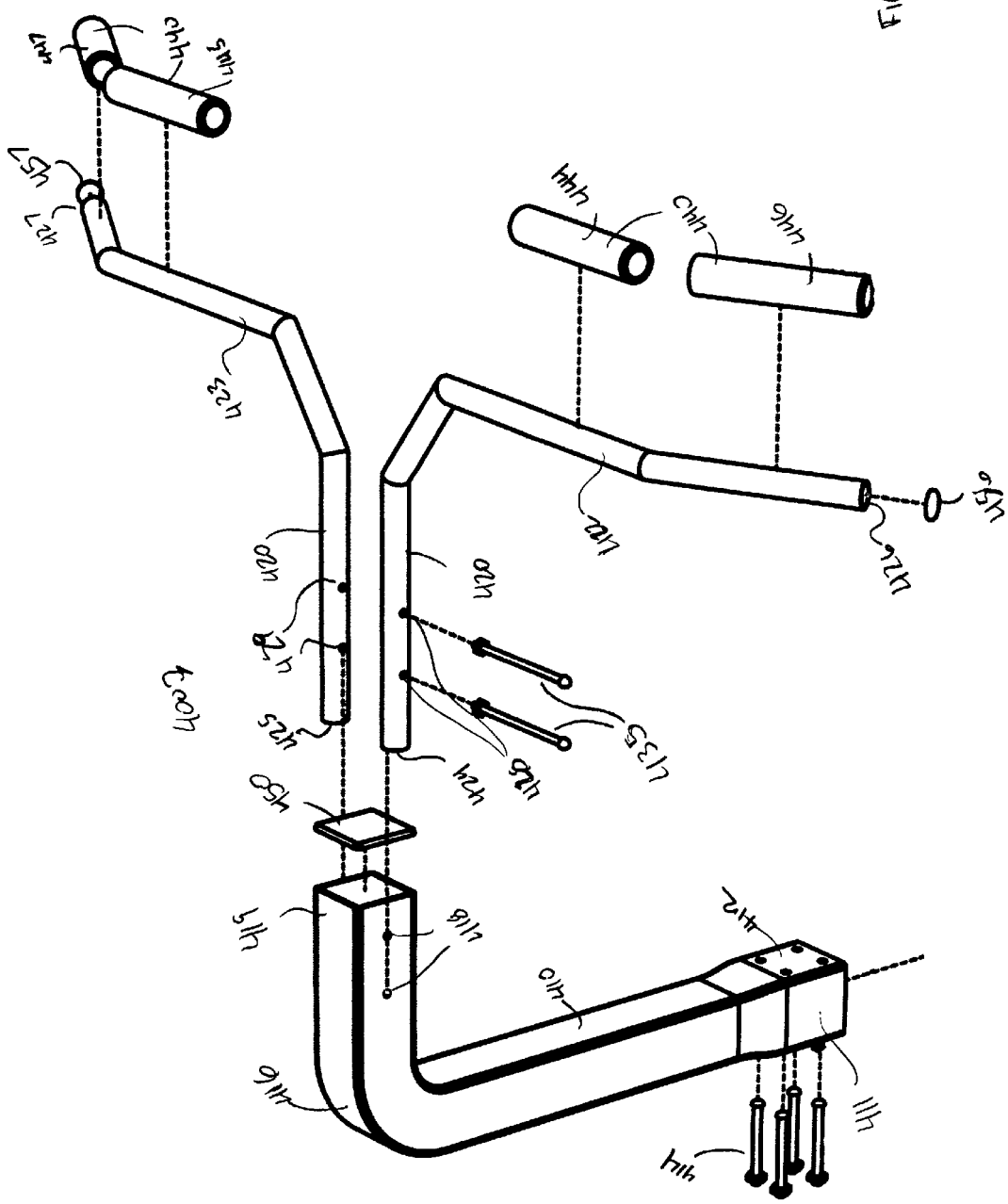
FIG. 4 is an exploded perspective view of the upper section shown in FIG. 1.
Figure 5:
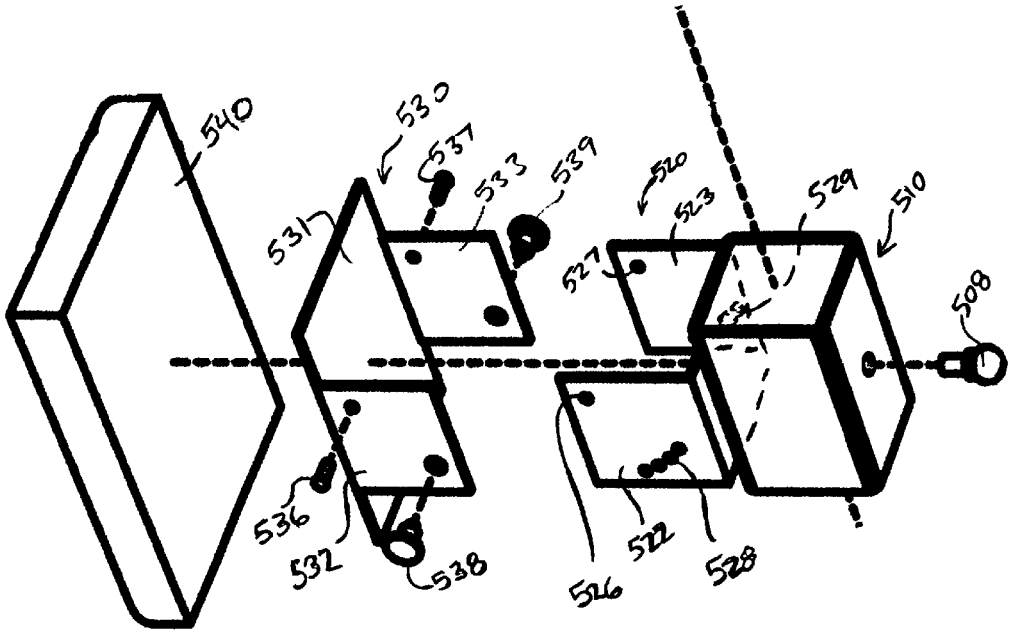
FIG. 5 is an exploded perspective view of the back support section shown in FIG. 1.
Figure 8:
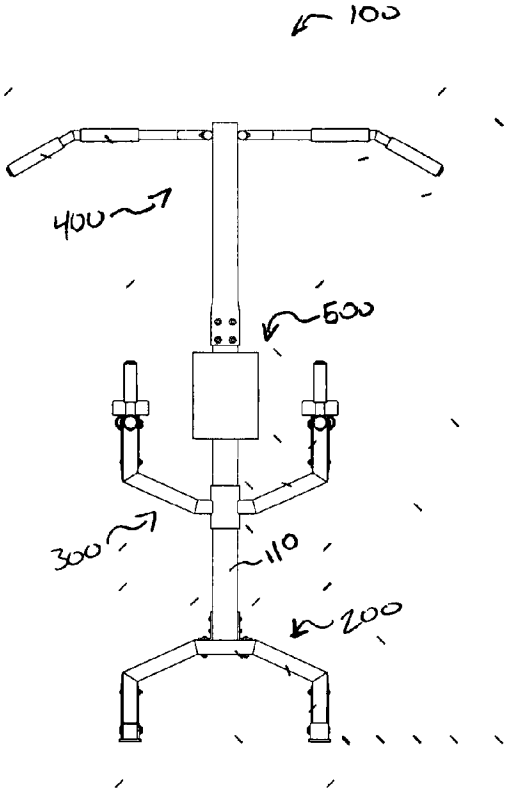
FIG. 8 is the back elevation view of the exercise device of FIG. 1.
Figure 7:
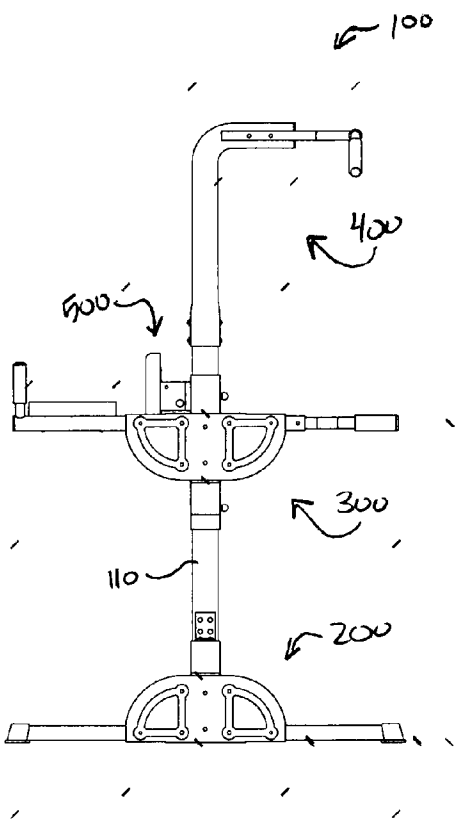
FIG. 7 is a side elevation view of the exercise device of FIG. 1.
Figure 6:
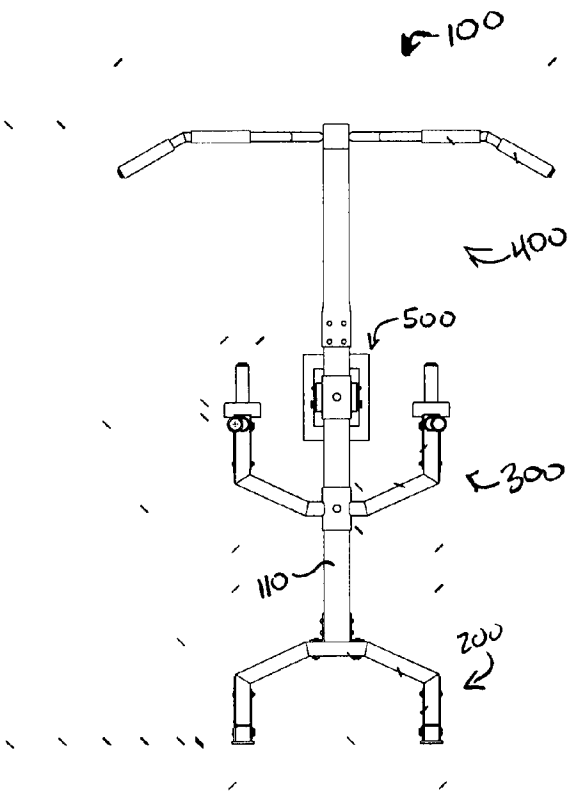
FIG. 6 is a front elevation view of the exercise device of FIG. 1.

Referring now to FIGS. 1-8, the exercise device of the present invention generally includes a base section, a middle section, and an upper section. The device may additionally include a back support section, upper handle bars, front bars, and arm supports. The device may be adjustable for easy storage, configurable to perform various exercise routines, and otherwise usable to exercise.

Referring now to FIGS. 1-8, the exercise device 100 will be discussed. The exercise device may be constructed modularly using various sections attachable to a vertical support tube 110. In one embodiment, the vertical support tube 110 may be an approximately square tube, for example, a 3½'×3½' square tube, without limitation. A lower end of the vertical support tube 110 may connect to a base section 200, which may include braces, brackets, and legs to support the device 100. A middle section 300 may be removably attachable to vertical support tube 110 and slidable about the vertical support tube 110. The middle section 300 may include front and rear bars that can be used to perform various exercise routines. An upper section 400 may attach at an upper end of the vertical support tube 110, and may include upper handles. A back support section 500 may optionally be removably attached to the vertical support tube 110. The back support section 500 may be slidably adjustable about the vertical support tube 110.

Referring now to FIGS. 1-2 and 6-8, the base section 200 will be discussed in greater detail. The base section 200 may be attached to the lower end of the vertical support tube 110. In one embodiment, a base brace portion 210 of the base section 200 may attach to the lower end of the vertical support tube 110. A horizontal base brace member 211 of the base brace portion 210 may approximately orthogonally receive the lower end of the vertical support tube 110. The horizontal base brace member 211 of the base brace portion 210 may be attached to the vertical support tube 110 via a first side horizontal base brace bracket 222 on a first side. The horizontal base brace member 221 may also be attached to a second side horizontal base brace bracket 223 on a second side. The first side horizontal base brace bracket 222 may be attached to the vertical support tube 110 via first side vertical support tube base mounting bolts 224. The first side horizontal base brace bracket 222 may also be attached to the horizontal base brace member 211 via first side base vertical support tube mounting bolts 226. Similarly, the second side horizontal base brace bracket 223 may be attached to the vertical support tube 110 via second side vertical support tube base mounting bolts 225. The second side horizontal base brace bracket 223 may also be attached to the horizontal base brace member 211 via second side base vertical support tube mounting bolts 227.

The horizontal base brace member 210 may be operatively connected to a first side diagonal base brace member 212 and a second side diagonal base brace member 213. The first side diagonal base brace member 212 may be additionally connected to a first side vertical base brace member 214. The second side diagonal base brace member 213 may be additionally connected to a second side vertical base brace member 215. Members 211 through 215 may collectively form the base brace 210.

The first side vertical base brace member 214 may include first side vertical base brace member mounting holes 216. The second side vertical base brace member 215 may include second side vertical base brace member mounting holes 217. Legs 240 may be connected to the base brace member 210 via the first side vertical base brace mounting member holes 216, second side vertical base brace member mounting holes 217, and additional connective structures that will be discussed below.

A first side base leg outer mounting plate 232 and a first side base leg inner mounting plate 234 may be connected to the first side vertical base brace member 214 via first side vertical base brace member bolts 218. For example, the first side vertical base brace member bolts 218 may first pass through mounting holes on the first side base leg outer mounting plate 232, continuing through the first side vertical base brace member mounting holes 216, further passing through mounting holes on the first side base leg inner mounting plate 234, after which the first side vertical base brace member bolts 218 may be secured. Skilled artisans will appreciate that bolts 218 may be secured via a threaded nut, wing nut, Cotter pin, or other bolts securing techniques without limitation.

A second side base leg outer mounting plate 233 and a second side base leg inner mounting plate 235 may be connected to the second side vertical base brace member 215 via second side vertical base brace member bolts 219. For example, the second side vertical base brace member bolts 219 may second pass through mounting holes on the second side base leg outer mounting plate 233, continuing through the second side vertical base brace member mounting holes 217, further passing through mounting holes on the second side base leg inner mounting plate 235, after which the second side vertical base brace member bolts 219 may be secured. Skilled artisans will appreciate that bolts 219 may be secured via a threaded nut, wing nut, Cotter pin, or other bolts securing technique, without limitation.

First side base leg mounting brackets 236 may be secured to the first side outer base leg mounting plate 232. First side legs 242, 244 may be pivotably attached to the first side base leg outer mounting plate 232 via the first side base leg mounting brackets 236. Second side base leg mounting brackets 237 may be secured to the second side outer base leg mounting plate 233. Second side legs 243, 245 may be pivotably attached to the second side base leg outer mounting plate 233 via the second side base leg mounting brackets 237.

More specifically, without limitation, the first side front leg 242, first side outer base leg mounting plate 232, and first side base leg mounting bracket 236 may include first side front leg mounting holes 246. A first side front leg mounting bolt 256 may be passed through the first side front leg mounting hole 246 of the first side base leg mounting bracket 236, through the first side front leg mounting hole 246 of the first side outer base leg mounting bracket 232, and through the first side front leg mounting hole 246 of the first side front leg 242, after which the first side front leg mounting bolt 256 may be secured.

Similarly, without limitation, the second side front leg 243, second side outer base leg mounting plate 233, and second side base leg mounting bracket 237 may include second side front leg mounting holes 247. A second side front leg mounting bolt 257 may be passed through the second side front leg mounting hole 247 of the second side base leg mounting bracket 237, through the second side front leg mounting hole 247 of the second side outer base leg mounting bracket 233, and through the second side front leg mounting hole 247 of the second side front leg 243, after which the second side front leg mounting bolt 257 may be secured.

As an additional example, without limitation, the first side back leg 244, first side outer base leg mounting plate 234, and first side base leg mounting bracket 236 may include first side back leg mounting holes 248. A first side back leg mounting bolt 258 may be passed through the first side back leg mounting hole 248 of the first side base leg mounting bracket 236, through the first side back leg mounting hole 248 of the first side outer base leg mounting bracket 234, and through the first side back leg mounting hole 248 of the first side back leg 244, after which the first side back leg mounting bolt 258 may be secured.

Similarly, without limitation, the second side back leg 245, second side outer base leg mounting plate 235, and second side base leg mounting bracket 237 may include second side back leg mounting holes 249. A second side back leg mounting bolt 259 may be passed through the second side back leg mounting hole 249 of the second side base leg mounting bracket 237, through the second side back leg mounting hole 249 of the second side outer base leg mounting bracket 235, and through the second side back leg mounting hole 249 of the second side back leg 245, after which the second side back leg mounting bolt 259 may be secured.

The first side front leg 242 may include a first side front leg pin 262. The front first side base leg mounting bracket 236 may include a first side front leg up position pin receiver 272 and a first side front leg down position pin receiver 276. The first side front leg 242 may pivot about an axis created by the first side front leg mounting bolt 256 such that the first side front leg pin 262 may be received by the first side front leg receivers 272, 276. The first side front leg pin 262 may be engaged, for example, by pushing a spring-loaded pin inward towards the interior of the first side front leg 242. In another example, the first side of leg pin 262 may be removably slid through the first side front leg pin receivers 272, 276 and associated hole of the leg 242.

For example, the first side front leg 242 may be oriented in an up position, positioning the first side front leg 242 approximately parallel with the vertical support tube 110, which may make the device 100 more compact and facilitate storage of the device. The first side front leg 242 may be maintained in the up position by temporarily locking the first side front leg pin 262 in the first side front leg up position receiver 272. In another example, the first side front leg 242 may be oriented in a down position, positioning the first side front leg 242 approximately orthogonal with the vertical support tube 110, which may make the device 100 more stable and ready to use for exercising. The first side front leg 242 may be maintained in the down position by temporarily locking the first side front leg pin 262 in the first side front leg down position receiver 276.

The second side front leg 243 may include a second side front leg pin 263. The front first side base leg mounting bracket 237 may include a second side front leg up position pin receiver 273 and a second side front leg down position pin receiver 277. The second side front leg 243 may pivot about an axis created by the second side front leg mounting bolt 257 such that the second side front leg pin 263 may be received by the second side front leg receivers 273, 277. The second side front leg pin 263 may be engaged, for example, by pushing a spring-loaded pin inward towards the interior of the second side front leg 243. In another example, the second side of leg pin 263 may be removably slid through the second side front leg pin receivers 273, 277 and associated hole of the leg 243.

For example, the second side front leg 243 may be oriented in an up position, positioning the second side front leg 243 approximately parallel with the vertical support tube 110, which may make the device 100 more compact and facilitate storage of the device. The second side front leg 243 may be maintained in the up position by temporarily locking the second side front leg pin 263 in the second side front leg up position receiver 273. In another example, the second side front leg 243 may be oriented in a down position, positioning the second side front leg 243 approximately orthogonal with the vertical support tube 110, which may make the device 100 more stable and ready to use for exercising. The second side front leg 243 may be maintained in the down position by temporarily locking the second side front leg and 263 in the second side front leg down position receiver 277.

The first side back leg 244 may include a first side back leg pin 264. The back first side base leg mounting bracket 236 may include a first side back leg up position pin receiver 274 and a first side back leg down position pin receiver 278. The first side back leg 244 may pivot about an axis created by the first side back leg mounting bolt 258 such that the first side back leg pin 264 may be received by the first side back leg receivers 272, 278. The first side back leg pin 264 may be engaged, for example, by pushing a spring-loaded pin inward towards the interior of the first side back leg 244. In another example, the first side of leg pin 264 may be removably slid through the first side back leg pin receivers 274, 278 and associated hole of the leg 244.

For example, the first side back leg 244 may be oriented in an up position, positioning the first side back leg 244 approximately parallel with the vertical support tube 110, which may make the device 100 more compact and facilitate storage of the device. The first side back leg 244 may be maintained in the up position by temporarily locking the first side back leg pin 264 in the first side back leg up position receiver 274. In another example, the first side back leg 244 may be oriented in a down position, positioning the first side back leg 244 approximately orthogonal with the vertical support tube 110, which may make the device 100 more stable and ready to use for exercising. The first side back leg 244 may be maintained in the down position by temporarily locking the first side back leg and 264 in the first side back leg down position receiver 278.

The second side back leg 245 may include a second side back leg pin 265. The back first side base leg mounting bracket 237 may include a second side back leg up position pin receiver 275 and a second side back leg down position pin receiver 279. The second side back leg 245 may pivot about an axis created by the second side back leg mounting bolt 259 such that the second side back leg pin 262 may be received by the second side back leg receivers 275, 279. The second side back leg pin 265 may be engaged, for example, by pushing a spring-loaded pin inward towards the interior of the second side back leg 245. In another example, the second side of leg pin 265 may be removably slid through the second side back leg pin receivers 275, 279 and associated hole of the leg 245.

For example, the second side back leg 245 may be oriented in an up position, positioning the second side back leg 245 approximately parallel with the vertical support tube 110, which may make the device 100 more compact and facilitate storage of the device. The second side back leg 245 may be maintained in the up position by temporarily locking the second side back leg pin 265 in the second side back leg up position receiver 275. In another example, the second side back leg 245 may be oriented in a down position, positioning the second side back leg 245 approximately orthogonal with the vertical support tube 110, which may make the device 100 more stable and ready to use for exercising. The second side back leg 245 may be maintained in the down position by temporarily locking the second side back leg and 265 in the second side back leg down position receiver 279. Skilled artisans will appreciate additional portions at which the legs can be located.

The legs 240 may include caps at their distal ends. The caps may help secure the device 100 during operation, reduce damage to a surface on which the device is located, and otherwise assist in operation of the device. The first side front leg 242 may include a first side front leg cap 252 at its distal end. The second side front leg 243 may include a second side front leg cap 253 at its distal end. The first side back leg 244 may include a first side back leg cap 254 at its distal end. The second side back leg 245 may include a second side back leg cap 255 at its distal end.

Referring now to FIGS. 1, 3, and 6-8, the middle section 300 will be discussed in greater detail. The middle section 300 may be attached to a middle portion of the vertical support tube 110. In one embodiment, a middle brace portion 310 of the middle section 300 may be slidably located about the vertical support tube 110, the middle brace portion 310 substantially wrapping around the vertical support tube 110. A middle portion securing pin 308 may be included by the middle brace portion 310 to temporarily fix the middle section 300 to a position on the vertical support tube 110. The middle portion securing pin 308 may be a threaded pin, a Cotter pin, or another type of securing pin that would be appreciated by a person of skill in the art.

A horizontal middle brace member 311 of the middle brace portion 310 may approximately orthogonally connect to the vertical support tube 110. The horizontal middle brace member 311 may be attached to the vertical support tube 110 via the middle brace portion 310. The horizontal middle brace member 310 may be operatively connected to a first side diagonal middle brace member 312 and a second side diagonal middle brace member 313. The first side diagonal middle brace member 312 may be additionally connected to a first side vertical middle brace member 314. The second side diagonal middle brace member 313 may be additionally connected to a second side vertical middle brace member 315. Members 311 through 315 may collectively form the middle brace 310.

The first side vertical middle brace member 314 may include first side vertical middle brace member mounting holes 316. The second side vertical middle brace member 315 may include second side vertical middle brace member mounting holes 317. Front bars 340 and arm supports 341 may be connected to the middle brace member 310 via the first side vertical middle brace mounting member holes 316, second side vertical middle brace member mounting holes 317, and additional connective structures that will be discussed below.

A first side middle outer mounting plate 332 and a first side middle inner mounting plate 334 may be connected to the first side vertical middle brace member 314 via first side vertical middle brace member bolts 318. For example, the first side vertical middle brace member bolts 318 may first pass through mounting holes on the first side middle outer mounting plate 332, continuing through the first side vertical middle brace member mounting holes 316, further passing through mounting holes on the first side middle inner mounting plate 334, after which the first side vertical middle brace member bolts 318 may be secured. Skilled artisans will appreciate that bolts 318 may be secured via a threaded nut, wing nut, Cotter pin, or other bolts securing technique, without limitation. The first side middle outer mounting plate 332 may additionally include a first side middle plate lip 338.

A second side middle outer mounting plate 333 and a second side middle inner mounting plate 335 may be connected to the second side vertical middle brace member 315 via second side vertical middle brace member bolts 319. For example, the second side vertical middle brace member bolts 319 may second pass through mounting holes on the second side middle outer mounting plate 333, continuing through the second side vertical middle brace member mounting holes 317, further passing through mounting holes on the second side middle inner mounting plate 335, after which the second side vertical middle brace member bolts 319 may be secured. Skilled artisans will appreciate that bolts 319 may be secured via a threaded nut, wing nut, Cotter pin, or other bolts securing technique, without limitation. The second side middle outer mounting plate 333 may additionally include a second side middle plate lip 339.

First side middle mounting brackets 336 may be secured to the first side outer middle mounting plate 332. First side front bar 342 and first side arm support 344 may be pivotably attached to the first side middle outer mounting plate 332 via the first side middle mounting brackets 336. Second side middle mounting brackets 337 may be secured to the second side outer middle mounting plate 333. Second side front bar 343 and second side arm support 345 may be pivotably attached to the second side middle outer mounting plate 333 via the second side middle mounting brackets 337.

More specifically, without limitation, the first side front bar 342, first side outer middle leg mounting plate 332, and first side middle mounting bracket 336 may include first side front bar mounting holes 346. A first side front bar mounting bolt 356 may be passed through the first side front bar mounting hole 346 of the first side middle mounting bracket 336, through the first side front bar mounting hole 346 of the first side outer middle mounting bracket 332, and through the first side front bar mounting hole 346 of the first side front bar 342, after which the first side front bar mounting bolt 356 may be secured.

Similarly, without limitation, the second side front bar 343, second side outer middle mounting plate 333, and second side middle mounting bracket 337 may include second side front bar mounting holes 347. A second side front bar mounting bolt 357 may be passed through the second side front bar mounting hole 347 of the second side middle mounting bracket 337, through the second side front bar mounting hole 347 of the second side outer middle mounting bracket 333, and through the second side front bar mounting hole 347 of the second side front bar 343, after which the second side front bar mounting bolt 357 may be secured.

As an additional example, without limitation, the first side arm support 344, first side outer middle mounting plate 334, and first side middle mounting bracket 336 may include first side arm support mounting holes 348. A first side arm support mounting bolt 358 may be passed through the first side arm support mounting hole 348 of the first side middle mounting bracket 336, through the first side arm support mounting hole 348 of the first side outer middle mounting bracket 334, and through the first side arm support mounting hole 348 of the first side arm support 344, after which the first side arm support mounting bolt 358 may be secured.

Similarly, without limitation, the second side arm support 345, second side outer middle mounting plate 335, and second side middle mounting bracket 337 may include second side arm support mounting holes 349. A second side arm support mounting bolt 359 may be passed through the second side arm support mounting hole 349 of the second side middle mounting bracket 337, through the second side arm support mounting hole 349 of the second side outer middle mounting bracket 335, and through the second side arm support mounting hole 349 of the second side arm support 345, after which the second side arm support mounting bolt 359 may be secured.

The first side front bar 342 and second side front bar 343 may be provided by the device 100 to facilitate performance of some exercise routines. For example, without limitation, the user may perform dips using the first side and second side front bars 342, 343.

The first side front bar 342 may connect to multiple components, for example, a first side bar handle 350. The second side front bar 343 may connect to multiple components, for example, the second side bar handle 351. The first side bar handle 350 may include a first side bar bend 370 and the second side bar handle 351 may include a second side bar bend 371. Changes in orientation of the first side and second side bar bends 370, 371 may modify the distance between the first side and the second side bars 342, 343 in associated handles 350, 351.

The first side front bar 342 may additionally include a first side bar orientation hole 366. The first side bar handle 350 may include a first side bar orientation pin 360. The first side bar handle 350 may be at least partially inserted into the first side front bar 342 such that the first side bar orientation pin 360 is receivable by the first side bar orientation hole 366. The first side bar handle 350 may be rotatable within the first side front bar 342 to adjust the orientation of the first side bar handle 350. For example, the first side bar orientation pin 360 may engage a first side bar orientation hole 366 located at the outside, top, or inside facing surface of the first side front bar 342. An additional first side bar orientation hole 366 may be included about at the bottom surface of the first side front bar 342. The first side and second side bar handles 350, 351 may optionally include first side and second side bar grips 368, 369, respectively.

The second side front bar 343 may additionally include a second side bar orientation hole 367. The second side bar handle 351 may include a second side bar orientation pin 361. The second side bar handle 351 may be at least partially inserted into the second side front bar 343 such that the second side bar orientation pin 361 is receivable by the second side bar orientation hole 367. The second side bar handle 351 may be rotatable within the second side front bar 343 to adjust the orientation of the second side bar handle 351. For example, the second side bar orientation pin 361 may engage a second side bar orientation hole 367 located at the outside, top, or inside facing surface of the second side front bar 343. An additional second side bar orientation hole 367 may be included about at the bottom surface of the second side front bar 343.

The first side front bar 342 may include a first side front bar pin 362. The front first side middle mounting bracket 336 may include a first side front bar up position pin receiver 372 and a first side front leg down position pin receiver 376. The first side front bar 342 may pivot about an axis created by the first side front bar mounting bolt 356 such that the first side front bar pin 362 may be received by the first side front bar receivers 372, 376. The first side front bar pin 362 may be engaged, for example, by pushing a spring-loaded pin inward towards the interior of the first side front bar 342. In another example, the first side of bar pin 362 may be removably slid through the first side front leg bar receivers 372, 376 and associated hole of the bar 2

For example, the first side front bar 342 may be oriented in an up position, positioning the first side front bar 342 approximately parallel with the vertical support tube 110, which may make the device 100 more compact and facilitate storage of the device. The first side front bar 342 may be maintained in the up position by temporarily locking the first side front bar pin 362 in the first side front bar up position receiver 372. In another example, the first side front bar 342 may be oriented in a down position, positioning the first side front bar 342 approximately orthogonal with the vertical support tube 110, which may make the device 100 more stable and ready to use for exercising. The first side front bar 342 may be maintained in the down position by temporarily locking the first side front bar pin 362 in the first side front bar down position receiver 376.

The second side front bar 343 may include a second side front bar pin 363. The front second side middle mounting bracket 337 may include a second side front bar up position pin receiver 373 and a second side front bar down position pin receiver 377. The second side front bar 343 may pivot about an axis created by the second side front bar mounting bolt 357 such that the second side front bar pin 363 may be received by the second side front bar receivers 373, 377. The second side front bar pin 363 may be engaged, for example, by pushing a spring-loaded pin inward towards the interior of the second side front bar 343. In another example, the second side of bar pin 363 may be removably slid through the second side front bar pin receivers 373, 377 and associated hole of the bar 343.

For example, the second side front bar 343 may be oriented in an up position, positioning the second side front bar 343 approximately parallel with the vertical support tube 110, which may make the device 100 more compact and facilitate storage of the device. The second side front bar 343 may be maintained in the up position by temporarily locking the second side front bar pin 363 in the second side front bar up position receiver 373. In another example, the second side front bar 343 may be oriented in a down position, positioning the second side front bar 343 approximately orthogonal with the vertical support tube 110, which may make the device 100 more stable and ready to use for exercising. The second side front bar 343 may be maintained in the down position by temporarily locking the second side front bar and 363 in the second side front bar down position receiver 377.

The first side arm support 344 and second side arm support 345 may be provided by the device 100 to facilitate performance of additional exercise routines.

The first side arm support 344 may connect to multiple components, for example, a first side arm pad 382 and a first side arm support handle 392. The first side arm support 344 may include first side arm pad mounting holes 384. The first side arm pad 382 may be attached to the first side arm support 344 by passing first side arm pad mounting bolts 386 through the first side arm support mounting holes 384 to be received by the first side arm pad 382. The first side arm support 344 may additionally include a first side arm support handle 392 attached approximately orthogonally to the first side arm support 344. A first side support handle grip 394 may be included around the first side support handle 392 to increase comfort for a user. A first side arm support cap 388 may be included by a distal end of the first side arm support 344. Similarly, the first side arm support handle cap 396 may be included by a distal end of the first side arm support handle 392.

The second side arm support 345 may connect to multiple components, for example, a second side arm pad 383 and a second side arm support handle 393. The second side arm pad 383 may be attached to the second side arm support 345 by passing second side arm pad mounting bolts 387 through the second side arm support mounting holes 385 to be received by the second side arm pad 383. The second side arm support 345 may additionally include a second side arm support handle 393 attached approximately orthogonally to the second side arm support 345. A second side support handle grip 395 may be included around the second side support handle 393 to increase comfort for a user. A second side arm support cap 389 may be included by a distal end of the second side arm support 345. Similarly, the second side arm support handle cap 397 may be included by a distal end of the second side arm support handle 393.

The first side arm support 344 may include a first side arm support pin 364. The first side middle mounting bracket 336 may include a first side back arm support position pin receiver 374 and a first side arm support down position pin receiver 378. The first side arm support 344 may pivot about an axis created by the first side arm support mounting bolt 358 such that the first side arm support pin 364 may be received by the first side arm support receivers 372, 378. The first side arm support pin 364 may be engaged, for example, by pushing a spring-loaded pin inward towards the interior of the first side arm support 344. In another example, the first side of arm support pin 364 may be removably slid through the first side arm support pin receivers 374, 378 and associated hole of the arm support 344.

For example, the first side arm support 344 may be oriented in an up position, positioning the first side arm support 344 approximately parallel with the vertical support tube 110, which may make the device 100 more compact and facilitate storage of the device. The first side arm support 344 may be maintained in the up position by temporarily locking the first side arm support pin 364 in the first side arm support up position receiver 374. In another example, the first side arm support 344 may be oriented in a down position, positioning the first side arm support 344 approximately orthogonal with the vertical support tube 110, which may make the device 100 ready to use for exercising. The first side arm support 344 may be maintained in the down position by temporarily locking the first side arm support and 364 in the first side arm support down position receiver 378.

The second side arm support 345 may include a second side arm support pin 365. The first side middle mounting bracket 337 may include a second side arm support up position pin receiver 375 and a second side arm support down position pin receiver 379. The second side arm support 345 may pivot about an axis created by the second side arm support mounting bolt 359 such that the second side arm support pin 362 may be received by the second side arm support receivers 375, 379. The second side arm support pin 365 may be engaged, for example, by pushing a spring-loaded pin inward towards the interior of the second side arm support 345. In another example, the second side of arm support pin 365 may be removably slid through the second side arm support pin receivers 375, 379 and associated hole of the arm support 345.

For example, the second side arm support 345 may be oriented in an up position, positioning the second side arm support 345 approximately parallel with the vertical support tube 110, which may make the device 100 more compact and facilitate storage of the device. The second side arm support 345 may be maintained in the up position by temporarily locking the second side arm support pin 365 in the second side arm support up position receiver 375. In another example, the second side arm support 345 may be oriented in a down position, positioning the second side arm support 345 approximately orthogonal with the vertical support tube 110, which may make the device 100 more stable and ready to use for exercising. The second side arm support 345 may be maintained in the down position by temporarily locking the second side arm support and 365 in the second side arm support down position receiver 379.

Referring now to FIGS. 1, 4, and 6-8, the upper section 400 will be discussed in greater detail. The upper section may include an upper support tube 410, upper handles 420, and other components. The upper support tube 410 may include a lower end attachable to the vertical support tube 110. The lower end of the upper support tube 410 may include upper support tube mounting holes 412 that can be used to attach the upper support tube 410 to the vertical support tube 410. Upper support mounting bolts 414 may be passed through the upper support mounting holes 412, through mounting holes provided by the vertical support tube 110, and through additional upper support mounting holes 412 of the upper support tube 410. The upper support mounting bolts 414 may be secured to substantially fix the upper support tube 410 to the vertical support tube 110.

The upper support tube 410 may include a first upper support tube side 411, a second upper support tube side 419, and an upper support tube bend 416 between the first and second upper support tube sides. The upper support tube bend 416 may reorient the direction in which the upper support tube 410 points. The upper support tube 410 may include upper support upper handle mounting holes 418, to which upper handles 420 may be attached. The upper support upper handle mounting holes 418 may be located at the second upper support tube side 411 of the upper support tube 410. A first side upper handle 422 may include first side upper handle mounting holes 428 at its first side upper handle support end 424. A second side upper handle 423 may include second side upper handle mounting holes 429 at its second side upper handle support end 425.

The upper handles 420 may be attached to the vertical support tube 410 via upper handle mounting bolts 435, which may pass through first side upper handle mounting holes 428 of the first side upper handle 422, through the upper support handle mounting holes 418 of the upper support tube 410, and through the second side upper handle mounting holes 429 of the second side upper handle 423.

The upper handles 420 may extend outwardly from the upper support tube 410, bending approximately midway such that first side upper handle 422 and second side upper handle 423 extend away from one another and approximately orthogonally from the upper support tube 410. More particularly, the first side upper handle distal end 426 of the first side upper handle 422 may extend in a direction approximately opposite to that of the second side upper handle distal end 427 of the second side upper handle 423.

Upper handle grips 440 may be included by the upper handles 420 to increase comfort for a user. A first side upper handle inner grip 444 and/or a first side upper handle outer grip 446 may be included by the first side upper handle 422. Similarly, the second side inner upper handle grip 445 and/or the second side outer upper handle grip 427 may be included by the second side upper handle 423. An upper support tube cap 450 may be connected to the upper support tube 410 about near the attachment of the upper handles 420. First side and second side upper handle caps 456, 457 may be connected to the distal ends 426, 427 of the first side and second side upper handles 422, 423, respectively.

Referring now to FIGS. 1 and 5-8, the back support section 500 will be discussed in greater detail. The back support section 500 may be attached to a middle portion of the vertical support tube 110. In one embodiment, a back support portion 510 of the back support section 500 may be slidably located about the vertical support tube 110, the back support portion 510 substantially wrapping around the vertical support tube 110. A back support portion securing pin 508 may be included by the back support portion 510 to temporarily fix the back support section 500 to a position on the vertical support tube 110. The back support portion securing pin 508 may be a threaded pin, a Cotter pin, or another type of securing pin that would be appreciated by a person of skill in the art.

A back support portion mounting bracket 520 may be attached to the back support portion 510. The back support portion mounting bracket 520 may include a first side back support portion mounting flange 522, which may further include a first side back support pivot hole 526 and one or more first side back support locking holes 528. The back support portion mounting bracket 520 may additionally include a second side back support portion mounting flange 523, which may further include a second side back support to the hole 527 and one or more second side back support locking holes 529.

The back support section 500 may additionally include a back support pad mounting bracket 530. The back support pad mounting bracket 530 may include a first side back support pad mounting flange 532, which may further include a first side back support pivot bolt 536 and a first side back support locking bolt 528. The back support pad mounting bracket 530 may additionally include a second side back support pad mounting flange 533, which may further include a second side back support pivot bolt 537 and a second side back support locking bolt 529. A back support pad 540 may be attached to a back support pad mounting surface 531 of the back support mounting bracket 530.

In operation, the device may be used to perform various exercise routines. A user of the device may interact with various components of the device to perform a multitude of exercise routines. Many components of the device are adjustable to accommodate various users and provide customized user experiences. For example, the back support pad of the back support system may be pivoted about an axis provided by the first side and second side back support pivot bolts and locked into a desired position using the first side and second side back support locking bolts. The angle of the back support pad may be customized according to the preference of the user. The back support pad may be tilted outwardly from the bottom to change its angular orientation between 1, 2, 3, 4, 5, 6, 7, 8, or more positions, facilitating leg raise, abdominal, and other exercises.

As an additional example, the middle section or back support sections of the device may be slidably relocated at various locations about the vertical support tube. The components may be substantially secured to the vertical support tube at a desired location using a securing pin.

The plates may connect the base and middle sections to other components of the device. Design and shape of these plates may use bolts and nuts to connect the upper handles and legs to the base, vertical support tube, and other components of the device. The plates may include holes that allow for pins or snap buttons to pop into them. The snap button embodiments of the pins are includable inside the tubing that makes up the upper handles, front bars, arm supports, and legs. The snap buttons may allow the respective components to release from one position and to swing into either an up or down position while substantially locking them into each of those positions.

The front bars may facilitate performing dip exercise routines. In one embodiment, the front bars may include about four pieces of round tubing, including two straight pieces and two that are bent. The two bent bars may have a narrower diameter so it can slide inside the other. The bent bars may have snap buttons inside of them to allow for the bent bars to rotate in three or more positions, for example, inside, top, and outside. Corresponding hole may be included for each of these positions to allow for the snap buttons to lock in.

In one embodiment, the upper portion may include a pull up or chin up station. These exercise routines may be facilitated by the approximately 90 degree bend in the square upper handle support tubing. The design of the illustrative two-piece, Y-shaped upper handle bars may advantageously increase functionality of the upper handles. The Y-shape of the upper handles may accommodate extra exercise routines, for example curl-type pull-ups, and may increase the number of positions in which to do this and other exercises.

In one embodiment, the device may be constructed using virtually any material, for example, metal. The device may use hardened materials capable of supporting the weight of a user. The device may additionally use materials to facilitate storage and transportation when not in use.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An exercise device comprising:

a vertical support tube;

a base section operatively attached at a bottom end of the vertical support tube, the base section further comprising:

a base brace attachable to the vertical support tube;

a base mounting plate attachable to the base brace; and a leg operatively attached to the base mounting plate, the leg being at least partially rotatable about a leg mounting bolt connected to the base mounting plate;

a middle section removably attachable to the vertical support tube, the middle section being movable about the vertical support tube, the middle section further comprising:

a middle brace adjustably positionable about the vertical support tube;

a middle mounting plate attached to the middle brace;

a front bar operatively attached to the middle mounting plate, the front bar being at least partially rotatable about a front bar mounting bolt connected to the middle mounting plate; and an arm support operatively attached to the middle mounting plate, the arm support being at least partially rotatable about an arm support mounting bolt connected to the middle mounting plate; and an upper section attachable to a top end of the vertical support tube, the upper section further comprising an upper handle;

wherein the leg, the front bar, and the arm support are rotatable to at least a down position and an up position.

2. The device of claim 1, further comprising a back support section attachable to the vertical support tube, the back support section further comprising a back support pad; wherein the back support section is movable about the vertical support tube between the base section and the upper section.

3. The device of claim 2, wherein the back support section further comprises:

a back support portion securable to the vertical support tube;

a back support mounting bracket attached to the back support portion; and a back support pad mounting bracket connectable to the back support mounting bracket via a back support pivot bolt, the back support pad mounting bracket being pivotal about the back support pivot bolt to orient the attached back support pad.

4. The device of claim 1:

wherein the base portion further comprises a base mounting bracket comprising:

a leg mounting hole, a leg pin up receiver, and a leg pin down receiver;

wherein the leg further comprises a leg pin;

wherein the leg is at least partially rotatable about the leg mounting bolt passed through the base mounting bracket, the base mounting plate, and the leg;

wherein the leg is selectively positionable in the up position by engaging the leg pin up receiver with the leg pin; and wherein the leg is selectively positionable in the down position by engaging the leg pin down receiver with the leg pin.

5. The device of claim 1:

wherein the middle portion further comprises a middle mounting bracket comprising:

a front bar mounting hole, a front bar pin up receiver, and a front bar pin down receiver;

wherein the front bar further comprises a front bar pin;

wherein the front bar is at least partially rotatable about the front bar mounting bolt passed through the middle mounting bracket, the middle mounting plate, and the front bar;

wherein the front bar is selectively positionable in the up position by engaging the front bar pin up receiver with the front bar pin; and wherein the front bar is selectively positionable in the down position by engaging the front bar pin down receiver with the front bar pin.

6. The device of claim 1:

wherein the middle portion further comprises a middle mounting bracket comprising:

an arm support mounting hole, an arm support pin up receiver, and an arm support pin down receiver;

wherein the arm support further comprises an arm support pin;

wherein the arm support is at least partially rotatable about the arm support mounting bolt passed through the middle mounting bracket, the middle mounting plate, and the arm support;

wherein the arm support is selectively positionable in the up position by engaging the arm support pin up receiver with the arm support pin; and wherein the arm support is selectively positionable in the down position by engaging the arm support pin down receiver with the arm support pin.

7. The device of claim 1:

wherein the upper section comprises an upper support tube extending from a first upper support tube end to a second upper support tube end;

wherein the upper support tube comprises an upper support tube bend between the first upper support tube end and the second upper support tube end;

wherein the first upper support tube end is approximately orthogonal to the second upper support tube end;

wherein the first upper support tube end of the upper support tube is attachable to the vertical support tube.

8. The device of claim 7:

wherein the upper handle is attachable to the second upper support tube end of the upper support tube;

wherein the upper handle extends from an upper handle support end to an upper handle distal end;

wherein the upper handle is bent between the upper handle support end and the upper handle distal end; and wherein the upper handle support end is approximately orthogonal to the upper handle distal end.

9. The device of claim 1, wherein the upper handle comprises a first side upper handle and a second side upper handle.

10. The device of claim 1, wherein the vertical support tube is an approximately square tube.

11. The device of claim 1, wherein the upper handle further comprises a grip.

12. The device of claim 1, further comprising:

bar orientation holes provided by the front bar; and a bar handle comprising a bar orientation pin receivable by the bar orientation holes;

wherein the bar handle is insertable into the front bar;

wherein the bar handle is rotatably oriented with respect to the front bar;

wherein the bar orientation pin is aligned with the bar orientation hole corresponding to an orientation.

13. The device of claim 1, wherein the arm support further comprises:

an arm pad mountable to the arm support; and an arm support handle approximately orthogonally mounted to the arm support.

* * * * *